US005211903A

United States Patent [19]

Reifenhäuser

[11] Patent Number: 5,211,903

[45] Date of Patent: May 18, 1993

[54] PROCESS AND APPARATUS FOR PRODUCING A SPUN-FIBER WEB FROM SYNTHETIC POLYMER

[75] Inventor: Hans Reifenhäuser, Troisdorf, Fed. Rep. of Germany

[73] Assignee: Silver-Plastics GmbH & Co. KG, Troisdorf, Fed. Rep. of Germany

[21] Appl. No.: 828,227

[22] Filed: Jan. 30, 1992

[30] Foreign Application Priority Data

Jan. 30, 1991 [DE] Fed. Rep. of Germany ..... 4102650

[51] Int. Cl.[5] ..... D01D 7/00

[52] U.S. Cl. ..... 264/555; 264/210.7; 264/210.8; 425/66; 425/72.2

[58] Field of Search ..... 264/555, 210.7, 210.8, 264/211.14, 556, 571; 425/66, 72.1, 72.2, 80.1, 83.1

[56] References Cited

U.S. PATENT DOCUMENTS 3,844,097 10/1974 Bobkowicz et al. ..... 425/66

FOREIGN PATENT DOCUMENTS 1939879 8/1970 Fed. Rep. of Germany ..... 425/66

*Primary Examiner*—Jill L. Heitbrink

*Attorney, Agent, or Firm*—Antonelli, Terry, Stout & Kraus

[57] ABSTRACT

A process and an apparatus for producing a spun-fiber web from filaments of a synthetic polymer which includes a device for taking off the filaments and a web-depositing device with suction unit wherein the filaments are taken off mechanically by means of a take-off roll with a unit for the defined raising of the frictional force between the roll surface and the filaments, the filaments being exposed, in particular, to a vacuum and/or to pressurized air.

19 Claims, 4 Drawing Sheets

PROCESS AND APPARATUS FOR PRODUCING A SPUN-FIBER WEB FROM SYNTHETIC POLYMER

BACKGROUND OF THE INVENTION

This invention relates to a process for the production of a spun-fiber web from filaments of a synthetic polymer wherein the filaments exit through spinnerets from a molten mass of synthetic polymer and are guided through a cooling well traversed by cooling air and, after cooling and strengthening, are seized mechanically by means of at least one take-off roll and are conducted over a portion of a surface of at least one takeoff roll, and thereafter the filaments are swirled and deposited to form the web on a depositing conveyor belt.

The invention furthermore concerns an apparatus for producing spun-fiber webs from filaments of a synthetic polymer exiting from a molten mass of synthetic polymer through spinnerets and being taken off mechanically, with an extruder for melting the synthetic polymer comprising a die head having a plurality of spinnerets for delivery of the filaments and with a cooling well adjoining the spinnerets and supplying air for cooling the filaments, a mechanical take-off device downstream of the cooling well with at least one take-off roll for taking off the filaments from the spinnerets, and a unit for forming the web in random array of the filaments, with an air-traversed diffuser and a perforated depositing conveyor belt with a suction unit.

Processes are known for the production of spun-fiber non-woven fabrics of stretched filaments made of synthetic polymers wherein the filaments are taken off the spinnerets from the melt either mechanically or aerodynamically and are subsequently additionally stretched in the strengthened condition.

In the reshaping of thermoplastic synthetic resins, a distinction is made between cold reshaping and hot reshaping. In case of amorphous thermoplastics the cold reshaping takes place below the glass transition temperature; in this connection, amorphous thermoplastics can be cold-formed and stretched only within limits. Partially crystalline thermoplastics are coldformed below their crystallite melting range and above their yield point, particularly stretched. Hot-forming takes place in case of amorphous thermoplastics above their softening temperature range in the thermoelastic state range; whereas partially crystalline synthetic resins can be thermoformed and stretched to a limited extent above their crystallite melting range and below the molten condition. All hot-forming processes are anisotropic and must be frozen in by cooling under tension up to a sufficient extent below the glass transition temperature and, respectively, the crystallite melting range.

In the process known from DOS 3,117,737 for the production of spun-fiber webs, the filaments, exiting from a molten thermoplastic mass out of the spinnerets and directly entering into a cooling chamber, are quenched and subsequently aerodynamically taken off the spinnerets by means of the flowing coolant and are stretched along the lines of a cold-forming operation. The drawing of the filaments as well as the stretching step take place aerodynamically, and the stretching step is conducted in the strengthened condition of the filaments. German Patent 3,400,847 likewise discloses a process for producing a spun-fiber fleece from stretched filaments of a thermoplastic synthetic resin by means of aerodynamic stretching of the filaments, taken off aerodynamically from a melt, in the strengthened, cooled condition.

U.S. Pat. No. 3,338,992 describes a process for the manufacture of a spun-fiber non-woven fabric from stretched filaments of thermoplastic synthetic resins wherein the filaments exiting from the spinneret are cooled and bonded and subsequently mechanically taken off and stretched by reheating to stretching temperatures below the crystallite melting zone mechanically by means of rolls. In contrast to the methods known from DOS 3,117,737 and German Patent 3,400,847 operating with aerodynamic treatment of the filaments, the process in U.S. Pat. No. 3,338,992 employs mechanical action upon the filaments, stretching being carried out as a cold-shaping of the filaments.

A process for the production of a spun-fiber web of filaments made of thermoplastic polymer is known from U.S. Pat. No. 3,509,009 wherein the filaments exit from the melt through spinnerets into a cooling shaft exposed to cooling air, and the filaments are drawn therefrom in aerodynamic fashion. Additionally, in this process, the filaments are exposed to hot air immediately after leaving the spinnerets in order to attain a reduction in cross section of the filaments in the molten condition of the polymer after exiting from the spinnerets by means of the subsequent aerodynamic take-off step in the cooling shaft. In this method, due to the additional injection of hot air, there is the danger of having the filaments exiting from the spinnerets stick to one another.

German Patent 3,603,814 discloses a process and apparatus for the production of a spun-fiber fleece from stretched filaments of a synthetic polymer wherein the filaments, leaving the spinnerets in the molten condition, are taken off mechanically from the spinneret and are subsequently stretched mechanically in the cold-reshaping zone before they are deposited in random array into a web and then bonded.

SUMMARY OF THE INVENTION

The invention is based on the object of improving the known methods for the production of spun-fiber webs from filaments of synthetic polymers so that the filaments can be taken off the spinnerets with a settable, controllable velocity and with definite acceleration from the thermoplastic melt, and high and uniform strengths can be attained for all of the filaments exiting from a spinning die, even without a subsequent stretching in a bonded condition.

This object has been attained according to this invention, in a process of the type for the production of spun-fiber webs from filaments of synthetic polymer exiting from spinnerets in the fluid molten state by the use of at least one take-up roll or drum rotating at a speed higher therein the discharges rate the spinnerets. The process of this invention makes it possible to increase the adhesive friction of the filaments on the take-off roll by exposing the filaments to a vacuum and/or compressed air in such a way that the filaments can be drawn off the spinnerets in molten state at defined acceleration and defined velocity uniformly for all filaments. Also in this process, the reduction of the exit cross section of the filaments from the spinnerets takes place in case of partially crystalline synthetic polymers in a state of the synthetic polymer above the crystallite melting range and, in case of amorphous synthetic polymers, above their softening temperature zone. On account of the high frictional force attainable in accordance with this invention, and thus entrainment of the filaments with the take-off roll, the drawing velocity of the filaments off the spinnerets can be regulated in correspondence with the rotational speed of the take-off rolls, as long as the filaments adhere, rather than slide, on the surface of the take-off roll.

According to the invention, a high strength of the filaments with very small diameters is likewise achieved in this take-off procedure for the filaments. This fashioning of the filaments is made possible by the mechanical entrainment of the filaments on the surface of the take-off roll, leading to a defined position and defined acceleration of all filaments. In order to accelerate the drawing of the filaments off the spinnerets in such a way that, upon the immediate exiting from the spinnerets, a hot-reshaping, i.e. reduction of the thread cross section and elongation, can take place simultaneously as well, a large entraining force of the filaments is required; this force is produced to the desired extent by way of a corresponding adhesive friction on the roll surface by additional action thereon by means of a vacuum and/or pressure air. Only thereby is the adequate acceleration of the take-off process made possible which, at the same time, also affords uniform acceleration and uniform take-off for all filaments exiting from a spinning head. Upon exposure of the filaments to a vacuum and/or compressed air, the filaments are exposed to the flow preferably approximately perpendicularly or at an angle of between about 90° and 40° with respect to their longitudinal axis; this flow comprising suction air or pressurized air. The mechanical take-off process according to this invention with increased adhesive friction and, respectively, elevated frictional force by additional external effects avoids irregularities as they can occur in case of an aerodynamic take-off of filament groups, especially on account of turbulences in marginal regions. Advantageous embodiments of the process according to this invention and of its practical performance will be understood from the following detailed description of the invention. The frictional force needed for the adhesion of the filaments to the take-off roll can be provided by suction air in the interior of a perforated take-off roll and/or by blowing air with an adequate contact pressure from the outside onto the take-off roll.

An apparatus of this type is fashioned, according to the invention, to include a take-off device having at least one take-off roll or drum for seizing or holding the filaments in parallel and/or conveying the filaments at a rate higher than the rate of discharge of the filament 5 from the spinning apparatus. The roll intended for taking off the filaments is associated with at least one device for the defined raising of the frictional force between the roll surface of the take-off roll and the filaments, in the region of a looping path distance formed by the filaments entrained or held on the roll surface. In accordance with the invention, units for increasing the frictional force operating by means of a vacuum and/or pressurized air are provided with preference. In this connection, it is possible, for example, to provide only one device operating with a vacuum or compressed air, or two devices, one of which operates with a vacuum and one with compressed air, or two devices operating with a vacuum. The take-off device according to this invention achieves high take-off speeds of the filaments exiting in a melt-fluid state from the spinnerets and to be drawn off therefrom. With a predetermined exit cross section of the filaments from the spinnerets, an increasing take-off speed results in a correspondingly greater elongation and thus cross sectional reduction of the filament, also accompanied by an increase in attainable strength of the filaments on account of the molecular orientation brought about by the strong elongation.

By regulating the vacuum and/or the pressurized air by means of which the filaments are pressed against the roll surface, the frictional force can be increased according to the invention in such a way that, with an increasing frictional force, i.e. adhesion of the filaments on the roll surface, the take-off speed can be raised by a correspondingly faster rotation of the roll for the filaments. The invention permits a variation of the take-off speed of the filaments from the spinnerets in a defined fashion so that filaments of varying strengths and cross sections can be drawn from predetermined spinnerets.

In order to increase the adhesive friction of the filaments on the take-off roll or drum, it is suggested to design the take-off roll to be hollow with a perforated cylindrical wall especially in the form of a suction drum, exhibiting in the interior a vacuum-exposable suction chamber associated with the region of the looping path distance of the filaments in order to act on the filaments through the perforated drum wall. By applying a vacuum, the filaments guided over the perforated suction drum are then held by suction on the surface and entrained with the revolving suction drum by way of adhesive friction. The filaments exiting from the spinnerets at an exit speed depending on the extruder output, the thermoplastic melt, and the spinneret design are now accelerated by the take-off roll which revolves at an essentially higher peripheral speed as compared with the exit velocity, so that the filaments pressed against the take-off roll are moved further at a conveying speed corresponding to the peripheral velocity of the take-off roll. On account of this high conveying speed of the take-off roll, the take-off speed of the filaments from the spinnerets is correspondingly increased. In this process, the reduction of the cross section of the filaments takes place in the melt-fluid condition above the crystallite melting zone in case of partially crystalline polymers directly upon exiting from the spinneret. This is also called a leading action of the take-off roll with respect to the filaments exiting from the spinneret. This leading action of the take-off roll can be increased in correspondence with the size of the adhesive friction attainable, i.e. the size of the frictional force with which the filaments are pressed against the surface of the take-off roll, without a sliding/slipping of the filaments.

Suitable at least partially crystalline synthetic polymers include polypropylene, polyethylene, polyethyleneterephthalate, polybutyleneterephthalate. Suitable amorphous synthetic polymers include polycarbonate. In case of partially crystalline synthetic polymers and in case of amorphous synthetic polymers the melt should be in a temperature range of at least 10° C. above the crystalline melting zone respectively softening temperature range of the involved synthetic polymer, for instance filaments made of polypropylene having a crystalline melting zone of about 160° to 165° C. should be heated up to a temperature of about 200° C., when leaving the spinnerets. In case of polyethyleneterephthalate respectively polybutyleneterephthalate, having a crystalline melting zone of about 250° C. respectively 225° C. the temperature of the melt leaving the spinnerets should be at least 270° C.

The synthetic polymer filaments being guided through a cooling well traversed by cooling air are so far cooled that they are solidified leaving the cooling well and being deposited on the surface of the take-off roll without deformation and without gluing to the surface of the take-off roll or to each other. The filaments leaving the cooling well are at least cooled down to a temperature of 30° to 60° C. below their crystalline melting zone respectively softening temperature.

In the process of the invention filaments can be produced having a titer of 0.5 up to 15 denier, especially very fine filaments of 0.5 to 3 denier or thicker filaments with 7 to 12 denier.

With the presence of a take-off roll having a smooth continuous surface, adhesion between filaments and roll surface can be increased by pressing the filaments onto the roll surface from the outside by means of pressurized air. For this purpose, it is possible to associate with the take-off roll on the outside a fan chamber that can be exposed to pressurized air, with outlet openings oriented onto the zone of the looping path distance of the filaments, leaving a through flow channel between the roll surface and the outlet openings of the fan chamber for the filaments.

Preferably, the frictional force is produced in accordance with the invention by a vacuum, i.e. suction air, in the interior of a take-off roll having a perforated structure, and by use of additional pressure air from the outside of the roll. A perforated take-off roll with a suction chamber is combined with a fan chamber in the opposite region of the suction chamber.

In order to attain a defined detachment of the filaments from the take-off roll a the end of the desired looping path distance, an additional feature is provided so that an exhaust chamber exposable to pressurized air, having outlet openings for the pressurized air oriented toward the interior of the perforated drum wall, is arranged adjoining the suction chamber at the end of the looping path distance, in order to lift the filaments off the surface of the suction drum.

The filaments, drawn off the spinnerets usually vertically in the downward direction, can impinge onto the take-off roll either tangentially or, alternatively, at an acute angle in case the take-off roll partially projects into the vertical take-off route of the filaments. In order to promote a defined and safe immediate adhesion of the filaments upon hitting the roll surface, it may be advantageous to arrange an additional blowing unit, operating by means of compressed air with a slot-shaped outlet port extending in parallel to the roil surface, on the outside of the filaments in front of their impingement zone onto the roll surface so that the filaments are blown directly onto the roll surface with the aid of this blow unit.

It is necessary for producing the non-woven fabric to provide that the filaments, taken off the spinnerets as a group of threads, are conducted without mutual contact through the cooling well, and cooled, and are spread apart again after leaving the take-off rolls in curtain form into individual filaments and are uniformly guided along the route in order to be subsequently swirled together and deposited to form the web of non-woven material. The thus-deposited random web can then be subjected to further treatments.

It is possible to feed the filaments, after having been lifted off the take-off roll, directly to a gravity chute with diffuser for acceleration and swirling of the filaments, and to deposit the swirled filaments onto the depositing conveyor belt which latter is exposed to suction air on its bottom side. The path distance of the filaments from their exit from the spinnerets to being deposited on the depositing conveyor belt is enclosed with respect to the outside, the air streams being exhausted via the suction chamber of the take-off roll and via the suction unit of the depositing conveyor belt, thus obtaining a closed circulation for the required air.

For cohesion of the filaments during withdrawal via the take-off roll, it can be advantageous to ionize the threads and correspondingly to provide a unit for ionization of the filaments prior to impingement of the latter on the take-off roll.

In order to increase the frictional force and thus in order to raise the take-off speed of the filaments from the die and/or in order to provide optionally a mechanical stretching unit for an additional coldforming step in the form of a stretching operation in the strengthened condition of the filaments, a further embodiment of the invention proposes to associate the take-off roll directly downstream thereof with a further roll which is fashioned as a perforated drum, in particular. In the interior of the perforated drum, it is possible to arrange an exhaust chamber that can be exposed to pressurized air, with outlet ports directed onto the region of the perforated drum wall, the gravity chute with diffuser then being disposed directly on the outlet side of the outlet ports adjoining the perforated drum in the vertical downward direction. In this arrangement, the take-off roll and the perforated drum are located preferably vertically one above the other for an S-shaped looping route of the filaments from the top toward the bottom. Between the take-off roll and the perforated drum, a gap is provided to freely pull the filaments therethrough. In the simplest case, the filaments are drawn from the first take-off roll via the perforated drum with a relatively large looping angle of the perforated drum up to $180_T$, the adhesion being provided solely by way of mechanical friction on the roll surface. At the end of the looping path, the filaments are blown directly into the adjoining accelerating duct with diffuser. With a synchronous operation of the take-off roll and o the subsequently disposed perforated drum, the latter merely transports the filaments. However, it is also possible to have the second roll, namely the perforated drum, operate with a lead with respect to the first take-off roll whereby stretching of the filaments can be attained in the transition from the take-off roll to the perforated drum in the strengthened condition of the filaments, i.e. below their crystallite melting point or below their glass transition temperature.

It is likewise possible to increase the adhesive friction of the filaments on the perforated drum by providing that either the filaments are blown on the outside onto the roll surface additionally by means of pressurized air and are pressed thereon, and/or that the perforated drum is equipped with a suction chamber in the interior so that the filaments are held by suction on the surface of the perforated drum by means of suction air. For blowing the filaments onto the surface of the perforated drum, the provision is made that a blast chamber exposable to compressed air is associated on the outside with the perforated drum, exhibiting outlet ports oriented onto the region of the looping path distance of the filaments on the perforated drum. A through channel—free space—for the filaments is arranged between the perforated drum and the outlet ports. For producing the suction power, the perforated drum has a suction chamber accommodated in the interior of the perforated drum and exposable to a vacuum, this chamber being associated with the looping path distance of the filaments on the perforated drum surface. In order to prevent the filaments from being pulled into the perforations and holes of the take-off roll or perforated drum in case of a high suction force or contact pressure of the blowing air, it is suggested to place a sieve belt onto the perforated rolls as a lining. The sieve belt moreover serves for attaining a larger suction area since the belt can be designed with a plurality of extremely fine holes.

In order to obtain blowing streams and contact pressures of the blowing air for the filaments on the roll surface that are advantageous from the viewpoint of flow dynamics and/or for promoting a lifting of the filaments off the roll surfaces at the end of the looping path distance that is favorable from the viewpoint of flow dynamics, it is proposed to subdivide the chambers for the blowing or exhausting of air onto and away from the filaments, exposable to pressurized air, by means of baffles into flow channels fashioned in the manner of nozzles, the flow directions of these channels, oriented toward the outlet ports, being directed for exhausting purposes maximally perpendicularly and for blowing purpose extending in the angular region between in parallel with the take-off direction of the filaments and perpendicularly thereto. In particular, the blow streams of the blow chambers are designed so that they impinge on the filaments preferably under an acute angle with respect to the take-off route of the filaments, thus avoiding turbulences in the marginal zones.

For the arrangements wherein, beside the take-off roll, a perforated drum is provided with a exhaust unit and a blow unit, without there being a suction chamber for the perforated drum for exhausting the air flowing out of the exhaust chamber, the provision is made that the gravity chute adjoining on the outlet side of the perforated drum flares in the manner of a goblet on one side in the direction of the arriving filaments in order to accommodate the air stream coming from the blowing units. At the same time, the goblet-like flaring portion serves for spreading apart the filaments blown off the perforated drum in order to feed these filaments in the subsequent acceleration duct in spread-open form to the diffuser for swirling purposes. With this design of the exhaust unit and the flaring of the connection of the gravity chute, it is possible to attain an especially satisfactory opening up of the filaments and subsequent uniform swirling of the latter.

For rendering the air streams and air conductance economical, the provision is made that the route of the filaments traversed from the exiting of the filaments out of the spinnerets via the cooling well, the take-off roll, optionally perforated drum, up to deposit on the depositing conveyor belt is encapsulated from the outside so that suction air and pressurized air—blowing air can be conducted and regulated in a circulating air system, optionally with fresh air supply.

BRIEF DESCRIPTION OF THE DRAWINGS

Additional advantageous embodiments of the invention will be described with reference to the embodiments in the accompanying drawings wherein.

DETAILED DESCRIPTION OF THE INVENTION

Figure 1:
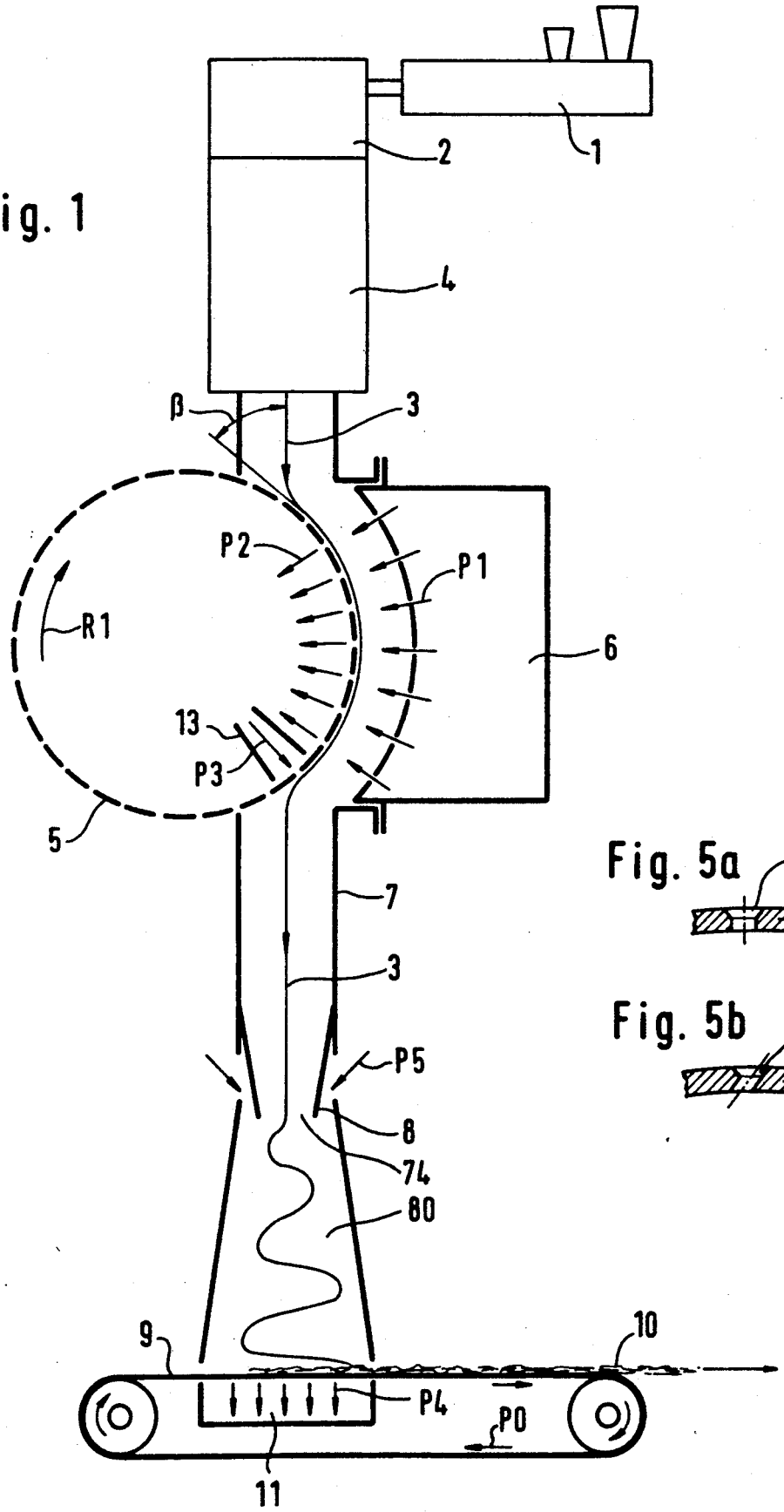
FIG. 1 shows a schematic view of an apparatus for the production of spun-fiber webs with a take-off device with take-off roll.

FIG. 1 provides a schematic representation an apparatus for producing a spun-fiber web of endless filaments of a synthetic polymer. Suitable synthetic polymers, besides polyolefins, such as polyethylene, polypropylene, include polyamides, polyesters, polystyrene, polyurethanes, polycarbonate, polyacetals, polyvinyl chloride, polyvinyl alcohol, cellulose acetate, and copolymers thereof. The synthetic polymer is melted in the extruder 1 and is spun via the die head 2, for example in the form of a spinning beam with a corresponding plurality of series-arranged spinnerets, to form filaments. The filaments exit from the spinnerets of the die head 2 in a melt-fluid state in the shape of a curtain of many parallel guided filaments dropping vertically under their own weight downwardly through the cooling well 4 adjoining the die head. The cooling well 4 is fed with cooling air so that the filaments 3 upon exiting from the cooling well 4 are adequately strengthened or solidified to be subsequently seized by the take-off roll 5 and to be entrained by way of adhesive friction. The take-off roll 5 revolves in the direction R1 at a speed sufficient for obtaining a lead with respect to rate of the melt-fluid exit of the filaments from the spinnerets of the die head, so that the filaments 3 are withdrawn from the spinnerets with immediate elongation and reduction of cross section at the exit; during this step, the filaments are additionally elongated and oriented in the hot-forming zone. The higher the attainable take-off speed of the filaments from the spinnerets, the higher the attainable bonding properties of the filaments. The adhesive friction and/or frictional force of the filaments 3 on the surface of the take-off roll 5 can be increased from the outside by exposing the filaments to a blast of compressed air, see arrows P1. The compressed air is supplied via the blow chamber 6 associated with a region of the looping path distance of the filaments on the takeoff roll 5. It is also possible to increase the frictional force and thus the adhesion of the filaments 3 on the roll surface of the take-off roll 5 by designing the take-off roll as a perforated hollow drum and exposing the interior thereof to suction air, vacuum, see arrows P2, so that the filaments lying on the perforated drum are sucked against the surface of the drum via the perforations. The combination of suction air from the take-off roll 5 fashioned as a suction drum and blowing air from the outside results in high frictional forces and thus in the possibility of correspondingly accelerating the withdrawal of the filaments 3 from the spinnerets.

The looping angle of the filaments on the takeoff roll ranges preferably between about 50° and 90°. The filaments 3 can impinge onto the take-off roll either laterally tangential or, as shown in FIG. 1, at an acute angle $\beta$. The filaments are guided perpendicularly with respect to each other downwards over the take-off roll 5 and taken off again. In the take-off zone, in case the take-off roll 5 is designed as a perforated drum, an exhaust chamber 13 is arranged on the inside, from which blowing air, see arrow P3, can be blown onto the filaments in order to promote the controlled, perfect lifting thereof from the roll surface. The filaments are then swirled and deposited to form the non-woven fabric.

In the schematic embodiment according to FIG. 1, a gravity chute is arranged following the take-off device, with an aerodynamic guidance of the filaments and subsequent swirling of the filaments by means of blowing air. The filaments 3 are withdrawn directly after being pulled off the take-off roll 5 vertically into the gravity chute 7 which passes over into a diffuser 8; the filaments coming out of the gravity chute 7 exit at the outlet opening 74 tapering in the manner of a nozzle and are swirled in the adjoining swirl shaft 80 and then deposited in random array on the perforated depositing conveyor belt 9. Underneath the perforated depositing conveyor belt 9 which revolves endlessly in the direction of arrow PO, a suction chamber 11 is arranged from which a suction air is continuously exhausted and removed from the swirl shaft 80 in the direction of arrow P4 through the deposited filaments. The thus-produced loose fleece 10 is then passed on to subsequent further processing, such as thermofixing, embossing, and so forth. In the zone of the outlet 74 of the gravity chute 7, blowing air is additionally supplied via slots in the direction of arrow P5, serving for the guiding and taking off of the filaments as well as for the subsequent swirling procedure.

Figure 2:
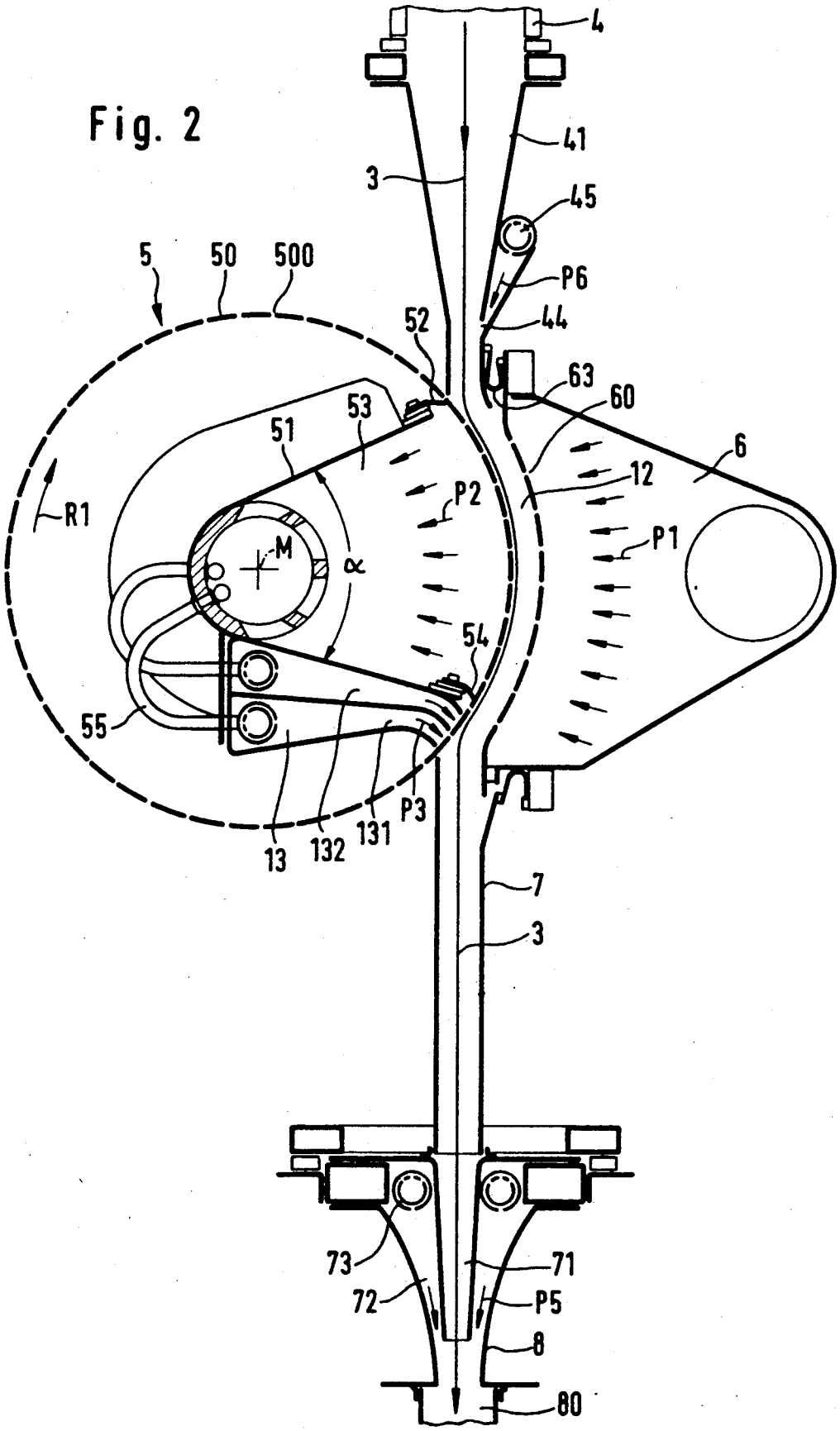
FIG. 2 shows a schematic view of a take-off device with a suction chamber, partially in cross-section, and a blow chamber.
Figure 3:
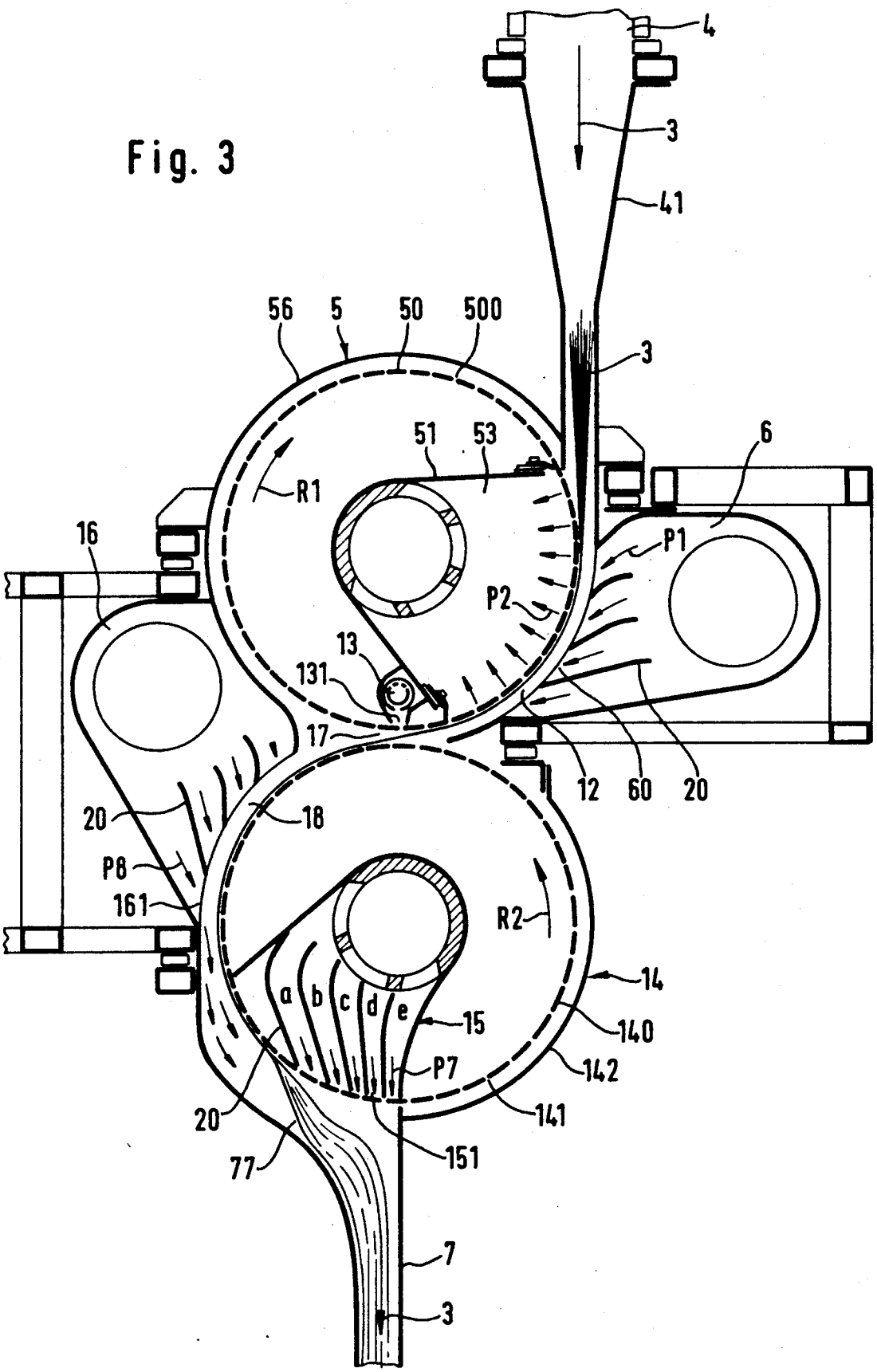
FIG. 3 shows a schematic cross-sectional view of a take-off device with two rolls.

FIG. 2 shows a take-off device for the filaments according to FIG. 1 with further details of the device, in a partially cross-sectional view. The take-off roll 5 is fashioned as a hollow suction drum with a rotating perforated drum wall 50 having holes or perforations 500. The take-off roll 5 is driven by a drive mechanism, not shown, and rotates in the direction of arrow P1 about an axis M. The take-off roll 5 is incorporated into the take-off path of the filaments 3 coming from the spinnerets in such a way that the filaments are entrained by adhering through adhesive friction over the portion of the circumference of the takeoff roll extending into the take-off route. In this arrangement, the looping path distance is designed to be continuous. In the revolving suction drum 5 according to FIG. 2, a stationary suction chamber 53 is formed which is connected to a vacuum-producing device, not illustrated in detail. The suction chamber 53 is fashioned in a segment shape in the region of the looping path, adjoining the drum wall o the inside in correspondence with the looping angle a, and is sealed by means of seals 52, 54 sliding on the drum wall. By exhausting the air in the direction of arrows P2, a vacuum is generated at the perforated drum wall of the suction drum 5 whereby the filaments 3 resting are urged on the outside against the roll surface. The suction chamber 53 is defined by the segmented housing 51. On the outside of the looping path distance of the filaments along the take-off roll, a blow chamber for positive pressure chamber 6 is additionally arranged, spaced therefrom to define a through flow channel 12, this chamber being equipped with outlet ports 60 for discharging the pressurized or compressed air P1, oriented toward the take-off roll 5. From this chamber 6, the filaments 3 are blown from the outside by means of the pressurized air streams onto the surface of the take-off roll 5 and held in place by pressure whereby their adhesion is increased. Depending o the required size of the frictional force, it is possible to provide that either only the chamber 6 together with a take-off roll having a continuous surface act on the filaments, or, alternatively, only a take-off roll 5 fashioned as a suction drum with a perforated drum wall or, alternatively, a suction drum with a perforated drum wall and a blow chamber with compressed air for generating positive pressure air streams from the outside. The route from the outlet of the cooling well 4 to the impingement of the filaments on the surface of the take-off roll is bridged in sealed fashion by the connecting conduit 41 with tapering cross section for accelerating the air flow. Also the suction drum 5 or take-off roll is sealed toward the outside by means of the housing 56 (as shown in FIG. 3). On the outside of the filaments 3, an additional blast of air from a blowing unit 45 can also act on the filaments in the direction of arrow P6 prior to their impingement on the roll surface, so that these filaments adhere in a defined fashion, simultaneously hitting the roll surface. The outlet opening of this additional blowing chamber 45 can be designed as a slot 44 in parallel to the roll surface. A connecting well 41 is connected via a gasket 63 to the blowing chamber 6 so that the path of the filaments and also the blowing air routes are enclosed on all sides. After the filaments have been entrained by way of adhesive friction on the surface of the take-off roll along the looping path distance, the filaments are further conducted, lifted off the take-off roll, in the vertical direction downwardly. In order to promote the flawless detachment of the filaments from the roll surface and a spread-open further guidance of the filaments, the lifting-off zone of the filaments is exposed to an air stream on the inside in case of a suction drum with perforated drum wall by means of pressurized air, see arrows P3. For this purpose, an exhaust or discharge chamber 13 is formed, adjoining the suction chamber 53, with, for example, two flow channels 131, 132 meeting the inner wall of the suction drum approximately perpendicularly and blowing the filaments off the roll surface through the holes 500. The filaments 3 are then fed directly to the diffuser 8 following, in sealed fashion via the gravity chute 7, the take-off roll 5 and the outlet of the blowing chamber 6. The accelerating channel 71 of the diffuser is fashioned in the manner of a nozzle and is supplied on the outlet side with additional blowing or discharging air, see arrows P5, by way of the blow feeding means 73 and the slot-shaped nozzle duct 72. The filaments, accelerated and thereby stretched while passing through the gravity chute and the nozzle 71, are subsequently swirled in the gravity chute 80 of the diffuser and then deposited on a conveyor or like surface to form the web. The air acceleration and swirling of the filaments in the diffuser can be varied, for example, by changing the pressure relationships of the additional air stream P5 in the diffuser region.

The suction air from the suction chamber 53 can be fed from the discharge side of a fan creating the suction, for example via conduits 55, directly to the blow chamber 13. The blast air from the blow chamber 6 is, in turn, exhausted via the suction chamber 53, in case a suction drum is provided, or it is exhausted partially by way of the gravity chute 7 and the diffuser 8 via the suction device of the depositing conveyor belt.

In FIG. 3, a take-off device made up of two take-up rolls is illustrated in cross section; these rolls are arranged vertically one above the other and are both designed as perforated rolls. The filaments 3 are here guided in an S-shape about the two rolls, providing tangential feed at the top roll and a central vertical delivery at the bottom roll as the take-off route for the filaments. The upper take-off roll 5 is designed as a suction drum with a perforated drum, as described in connection with FIG. 2; this drum is associated, along the looping zone, with the blow chamber 6 for blast air P1. The flow channels for the blast air P1 are subdivided by baffles 20 into nozzle-shaped flow channels impinging at an acute angle on the filaments 3 in the take-off direction. The second perforated drum 14 arranged below the take-off roll 5 revolves in the direction of arrow R2 and can be utilized as a mere conveying roll or also as a stretching roll. The perforated drum 14 has then the function of a conveying roll when traveling in synchronism with the take-off roll 5. By looping the filaments along a segment of the perforated drum 14, adhesive friction is increased and thus entrainment of the filaments is improved. Correspondingly, the take-off speed can be increased by a correspondingly high speed of rotation of the take-off roll 5 and the perforated drum 14. With a lead of the perforated drum 14 with respect to the take-off roll 5, stretching of the filaments is obtained between the two rolls in the free passage slot 17, this being a stretching in the strengthened condition of the filaments. This stretching step can be adjusted in its magnitude in correspondence with the difference of the traveling speeds of the take-off roll 5 and the perforated drum 14. In order to increase the adhesion friction of the filaments on the roll surface of the roll 14 designed as a perforated drum, it is likewise possible to provide a blowing chamber 16 from which blast air is blown in the direction of arrows P8 via outlet ports 161 onto the surface of the roll 14 and the filaments. Between the perforated drum 14 and the blow chamber 16, there remains also an adequate vacant space as the passage channel 18. The outlet ports 161 for the blast air P8 can also be constituted by nozzle-like flow channels shaped via baffles 20 in a manner that is favorable from the view point of flow dynamics. Also the perforated drum 14 is surrounded on the outside by a housing 142 and thus is sealed with respect to the surroundings.

The gravity chute 7 for the filaments is arranged in a vertical, downward direction in the detachment zone of the filaments 3 from the perforated drum 14. For detaching the filaments from the surface of the perforated drum 14 and opening up into a uniform curtain, the blast chamber or blow chamber 15 is arranged within the perforated drum 14, from which blast air is blown in the direction of arrow P7 onto the inner wall 140 of the perforated drum 14 and through the holes 141 onto the filaments so that the filaments can be uniformly lifted off. The blast chamber 15 is, in turn, subdivided in a manner favorable with respect to flow dynamics by means of baffles 20 into nozzle-like flow ducts a, b, c, d, and e with outlet openings 15, to obtain a satisfactory exhaust effect.

In order to accommodate the air streams from the blast chamber 16 and the exhaust chamber 15, the gravity chute 7 for the filaments is of a cup-like shape in the direction of the arriving filaments up to the location where it passes over into the through duct 18, and the blast chamber 16 is equipped with a goblet-like flaring portion 77. In this way, sufficient space is provided for accommodating the blast air and for spreading the filaments, blown off the surface of the perforated drum, apart in the manner of a curtain, and for introducing this filament curtain uniformly into the gravity chute 7. The filaments can be stretched either mechanically by providing a lead of the perforated drum 14 with respect to the take-off roll 5 or, alternatively, in addition to or in place of this mechanical stretching step, in an aerodynamic fashion while passing through the gravity chute and the diffuser nozzle.

Figure 4:
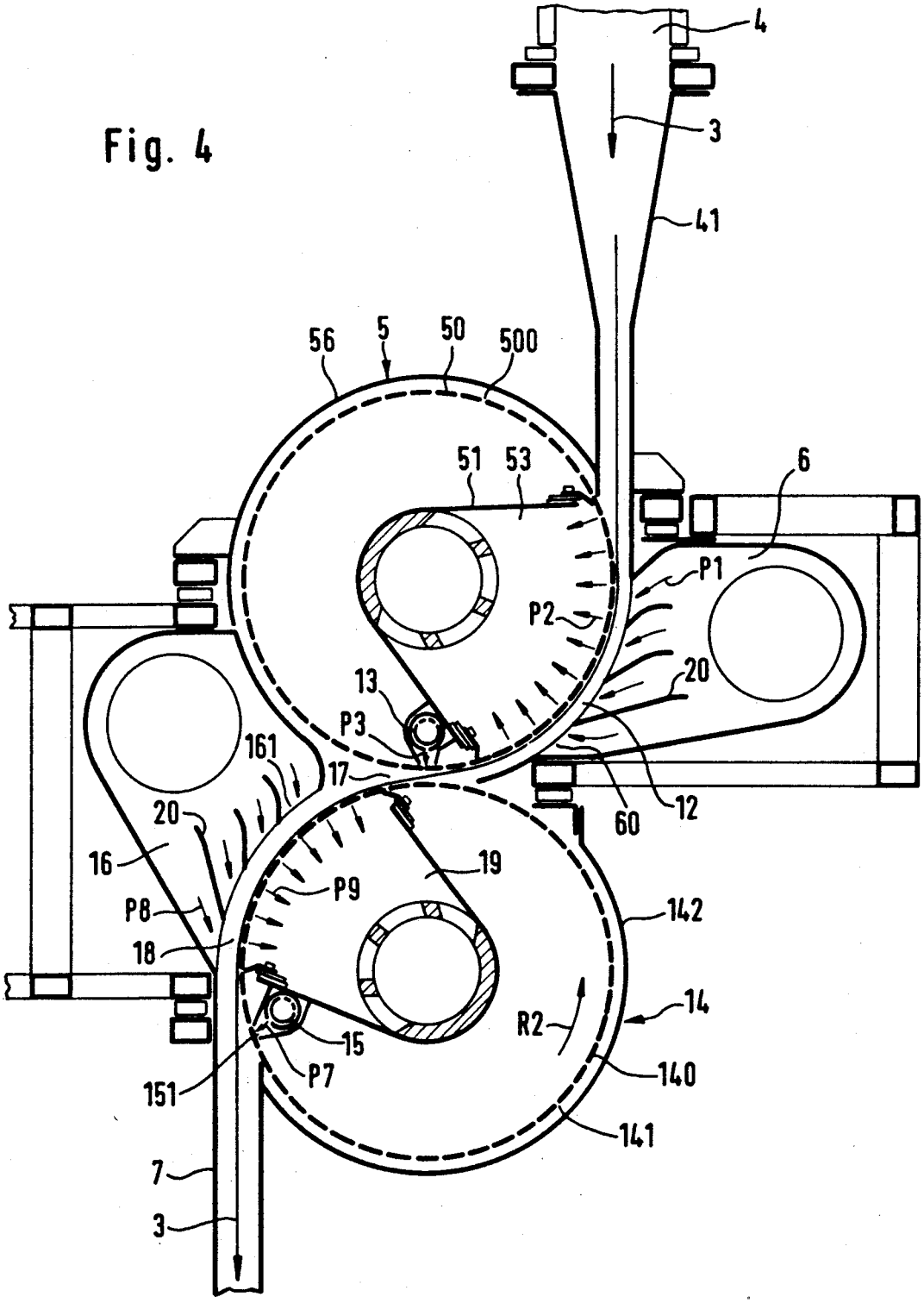
FIG. 4 shows a schematic cross-sectional view of a take-off device with two rolls, each equipped with a suction chamber.

FIG. 4 illustrates a take-off device in cross section for the filaments, consisting of a pair of rolls fashioned identically as suction drums, namely a take-off roll 5 with a subsequently arranged perforated drum 14. Both rolls 5 and 14 are designed with, respectively, one suction chamber 53 and 19, accommodated in the interior of the roll and each being exposed to a vacuum, see direction of arrows P2, P9, so that the filaments 3 guided over the surface of the rolls firmly adhere to the roll surfaces due to suction applied via the holes in the rolls. At the end of the suction chambers 53 and 19 and at the end of the desired looping path distance of the filaments on the rolls, respectively, one exhaust unit 13 or 15 is arranged in order to blow exhaust air from the inside through the holes of the rolls onto the filaments and to lift the filaments off a roll surface. Furthermore, each suction chamber 53 and 19 of each roll 5 and 14 is associated on the outside with a blast chamber 6 or 16 with blast air for the filaments. A free gap 17 remains between the two rolls 5 and 14, through which the filaments are conducted from one roll to the other roll. By providing a lead of the roll 14 with respect to the roll 5, it is likewise possible to effect a defined stretching of the filaments in the roll nip 17. In the embodiment according to FIG. 4, the filaments are guided tangentially to the upper take-off roll 5 and removed tangentially from the bottom perforated drum 14. In this arrangement, the gravity chute 7 is added on directly tangentially in the arrow direction and take-off direction of the filaments 3. The path of the filaments from the spinneret to the depositing conveyor belt, accompanied by air streams, is sealed toward the outside externally of the channels in order to provide a closed system for the air conductance.

Figure 5A:
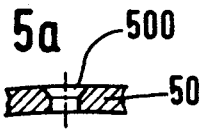
FIGS. 5*a, b* show two embodiments of holes for the suction roll.
Figure 5B:
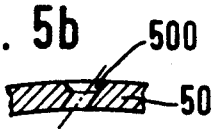

For obtaining an optimum suction effect at the suction drum and/or the perforated drum in the region of the suction chambers, the holes 500 and, respectively, 141 in the wall of the rolls can be designed favorably from the viewpoint of flow dynamics. FIGS. 5*a*, 5*b* show two versions of the embodiments of the suction holes 500 of suction roll 5 in cross section. In each case, the suction holes or bores should exhibit a conical depression on the side adjoining the filaments. Moreover, it may be advantageous, as shown in FIG. 5*b*, to arrange the suction bores to be inclined in the take-off direction of the filaments, rather than being of radial orientation.

The blast or suction chambers accommodated in the rolls and the blast chambers associated externally with the rolls in the looping zone of the filaments are stationary in their arrangement, and are optionally adjustable.

It is possible by means of the take-off devices described in connection with FIGS. 1–4, wherein the filaments are mechanically entrained via rolls and by way of a corresponding adhesive friction, to adjust the velocity with which the filaments are drawn out of the spinnerets in a defined fashion. In this connection, the frictional force and thus the adhesive friction of the filaments on the roll surfaces can likewise be adjusted by corresponding pressure gradients of suction chamber and blast air. The higher the take-off speed at which the filaments can be drawn off the nozzles in the melt-fluid and/or thermoplastic condition, and the larger the cross-sectional reduction of the filaments during this process, the higher is also the attainable strength of the filaments. Moreover, these take-off devices permit not only a high take-off velocity but also a uniform take-off velocity for all filaments withdrawn from a spinneret head.

The process of the invention is further exemplified in the following examples.

EXAMPLE 1

Filaments of Polypropylene

Polypropylene homopolymer with a melt index MFI (2.16) 35 g/10 min. is heated up and molten in an extruder up to a temperature of 210° C. The spinnerets have an exit cross section of 0.35 mm for the polypropylene melt of 210° C. The filaments leaving the spinnerets are drawn with a velocity of 2,400 m/min. by the take-off roll. The first take-off roll, see FIG. 3, has a diameter of the perforated drum 50 of 700 mm and the second take-off roll has a perforated drum 140 with a diameter of 900 mm. The peripheral speed of the take-off rolls, i.e. the perforated drums, is at least 2,400 m/min. Both take-off rolls 5 and 14 are operated with vacuum. Finally, a polypropylene filament of 1.95 denier is received and deposited to form a web.

EXAMPLE 2

PET Filament

Polyethyleneterephthalate is heated up and molten in an extruder to a temperature of 278° C. The exit cross section of the spinneret is round having a diameter of 0.8 mm. The filaments are withdrawn from the spinnerets by the take-off rolls with a velocity of 3,500 m/min. whereby the circumferential speed of the take-off rolls is at least 3,500 m/min. The take-off rolls used are the same as in Example 1. The apparatus is designed according to FIG. 3. There are produced PET filaments of 8 denier, which are then laid down to a web.

In Example 1, there was used cooling air of 15° C. in the cooling well for cooling down the filaments being withdrawn from the spinnerets.

In Example 2, cooling air of a temperature of 30° C. was used in the cooling well.

What is claimed is:

1. A process for the production of a spun-fiber web from filaments of a synthetic polymer wherein the filaments exiting through spinnerets from a molten mass of synthetic polymer are guided through a cooling well traversed by cooling air and, after cooling and strengthening, are conducted over a portion of a surface of at least one take-off roll; and thereafter the filaments are swirled and deposited on a depositing conveyor belt to form said web, characterized in that a conveying velocity of a take-off roll at which the filaments arrive is controlled to be substantially higher than an exit speed of the filaments from the spinnerets; the filaments resting on the surface of the take-off roll, are exposed in a pressing zone to compressed air acting from the outside on the surface of the take-off roll, and are pressed against the surface of the take-off roll whereby adhesive friction of the filaments on the take-off roll is increased; and the filaments are accelerated by rotation of the take-off roll so that the exit cross section of the filaments exiting the spinnerets is reduced at a state of the synthetic polymer of the filaments which, in the case of partially crystalline polymers, is in a range above the crystallite melting zone of the synthetic polymer and which, in case of amorphous synthetic polymers, is in a range above the softening temperature zone of the synthetic polymer; the filaments initially pressed against the surface of the take-off roll in the pressing zone are lifted off from the surface of the take-off roll at the end of the pressing zone by streams of compressed air acting from the interior of the take-off roll through perforations in the surface of the take-off roll on the filaments; and the adhesive friction of the filaments on the surface of the take-off roll is increased in the pressing zone by exposing the filaments to a vacuum from an interior of the take-off roll; the vacuum being generated in a suction chamber in the interior of the take-off roll and acting on the filaments via the perforations in the surface of the take-off roll and the compressed air acting from outside on the surface of the take-off roll being exhausted partially via the suction chamber in the interior of the take-off roll; and the compressed air acting from the interior of the take-off roll through the perforations in the surface of the take-off roll to lift off the filaments at the end of the pressing zone being fed from a discharge side of a fan creating the vacuum in the suction chamber.

2. A process according to claim 1, characterized in that the filaments are guided in an S-shape looping path over two take-off rolls, the filaments being pressed on a surface of a first take-off roll by compressed air from the outside and by suction air drawn in by a vacuum from inside of the first take-off roll and the filaments being pressed on a surface of the second take-off roll by compressed air directed from outside of the second take-off roll.

3. A process according to claim 2, characterized in that the filaments are pressed on the surface of a second take-off roll additionally by suction air from the inside of the second take-off roll acting through perforations in a wall of the second take-off roll.

4. A process according to claim 2, characterized in that the filaments are transported by the two take-off rolls being synchronous operated.

5. A process according to claim 3, characterized in that the filaments leaving the first take-off roll are stretched by operating the second take-off roll with a higher rotation with respect to the first take-off roll.

6. An apparatus for the production of a spun-fiber web from filaments of a synthetic polymer extruded through spinnerets of a die head which comprises an extruder for extruding the synthetic polymer through the die head; a cooling well adjoining the spinnerets, which is exposed to air, for cooling the filaments; at least one take-off roll arranged downstream of the cooling well for withdrawing the fibers from the spinnerets, the filaments being guided along a looping path distance on a surface of a perforated wall of the at least one take-off roll; and means for forming a random array of the filaments into said spun-fiber web, characterized in that a take-off roll for initially receiving the filaments has drive means controllable in dependence on an exit speed of the filaments from the spinnerets for effecting rotation of the first take-off roll whereby peripheral speed of the first take-off roll corresponds to the conveying velocity of the filaments, the drive means being controlled in such a way that the conveying velocity of the filaments is substantially higher than the exit speed of the filaments from the spinnerets; means for increasing the frictional force between the surface of the first take-off roll and the filaments guided thereon in a zone of the looping path distance of the filaments, said means for increasing the frictional force including a unit positioned outside the take-off roll for directing compressed air onto the filaments to press the filaments against said surface; an exhaust chamber arranged in the interior of the first take-off roll at the end of the looping path distance, said exhaust chamber having exhaust openings for directing compressed air towards the perforated wall of the take-off roll to pass the compressed air through perforations and to lift the filaments off the surface of the take-off roll; the take-off roll comprising a suction drum which has in its interior a suction chamber associated with the zone of the looping path distance of the filaments for applying suction to the filaments through the perforated wall to also increase the functional force of the filament against the drum surface and the exhaust chamber being connected via conduits to an exhaust side of a fan for applying a vacuum to said suction chamber.

7. An apparatus according to claim 6, characterized in that the unit of the means for increasing the frictional force between the filaments and the surface of the take-off roll comprises a blast chamber positioned adjacent to the take-off roll and having outlet ports, the outlet ports being arranged along the zone of the looping path distance of the filaments on a take-off roll and directing the compressed air onto the filaments so that the filaments are pressed against the surface of the take-off roll, said blast chamber being positioned to provide a through-flow channel between the surface of the take-off roll and the outlet ports of the blast chamber for passage of the filaments.

8. An apparatus according to claim 6, characterized in that said unit comprises a blast unit operating by means of compressed air and provided with a slot-like outlet opening, wherein the outlet opening is located at the end of the cooling well in order to blow the filaments exiting from the cooling well onto the surface of the take-off roll.

9. An apparatus according to claim 6, characterized in that the suction chamber is fashioned to adjoin the segment of the looping path distance formed by the looping angle of the filaments on the roll surface of about 50° to 90°, on the inside of the suction drum, and is sealed with respect to the drum surface by means of a sliding seal.

10. An apparatus according to claim 6, characterized in that a device is provided for ionizing the filaments before their impingement upon the take-off roll.

11. An apparatus according to claim 6, characterized in that two take-off rolls are provided and form an S-shaped looping path for the filaments, and at least one of the two take-off rolls is associated with a unit for increasing the frictional force and for urging the filaments onto the surface of the take-off roll, wherein a gap for the free pulling through of the filaments is provided between the first take-off roll and the second take-off roll designed as a perforated drum.

12. An apparatus according to claim 11, characterized in that the take-off roll disposed directly after the first take-off roll is fashioned to be hollow with a perforated roll wall as a perforated drum, and an exhaust chamber that can be exposed to compressed air is arranged in the interior of the perforated drum, with outlet openings, oriented onto the region of the perforated roll wall, at the end of the looping path distance for the filaments.

13. An apparatus according to claim 12, characterized in that the perforated drum is associated on the outside with a blast chamber exposable to compressed air, with outlet ports oriented toward the region of the looping path distance of the filaments on the perforated drum, leaving a pull-through channel between the perforated drum and the outlet ports for the filaments.

14. An apparatus according to claim 12, characterized in that a sieve belt is mounted onto the perforated take-off roll and/or the perforated drum.

15. An apparatus according to claim 11, characterized in that the take-off roll and the perforated drum are arranged vertically one above the other for an S-shaped looping path of the filaments from the top toward the bottom.

16. An apparatus according to claim 6, characterized in that a gravity well with diffuser for the filaments is connected, extending in the vertical direction downwardly, directly at the outlet side of the last take-off roll.

17. An apparatus according to claim 16, characterized in that the gravity well is widened, in the junction zone to the perforated drum, on one side in the direction of the arriving filaments, encompassing in goblet shape the detachment zone of the filaments from the perforated drum.

18. An apparatus according to claim 6, characterized in that the chambers, supplied with suction or compressed air and associated with the take-off rolls, for blowing the filaments onto the surface of the take-off roll or for blowing off and lifting the filaments off the surface of the take-off roll are subdivided by means of baffles into flow ducts shaped in the manner of nozzles, the flow directions of the latter, for blowing onto the filaments, are oriented in an angular zone between in parallel to the take-off direction of the filaments and perpendicularly thereto and, for blowing the filaments off, are oriented approximately perpendicularly to the take-off direction of the filaments.

19. An apparatus according to claim 6, characterized in that the traveling path of the filaments traversed from the exiting of the filaments from the spinnerets via the cooling well, the take-off roll, up to the means for forming a random array of the filaments into said spun-fiber web wherein the filaments are deposited on a depositing conveyor belt, is enclosed by a housing means with respect to the outside in order to prevent pressure losses and efflux of ambient air.

* * * * *